US010840006B2

(12) United States Patent
Cha

(10) Patent No.: US 10,840,006 B2
(45) Date of Patent: Nov. 17, 2020

(54) THIN FILM COIL COMPONENT

(71) Applicant: SAMSUNG ELECTRO-MECHANICS CO., LTD., Suwon-si (KR)

(72) Inventor: Il Ho Cha, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 109 days.

(21) Appl. No.: 15/976,759

(22) Filed: May 10, 2018

(65) Prior Publication Data

US 2019/0180912 A1 Jun. 13, 2019

(30) Foreign Application Priority Data

Dec. 7, 2017 (KR) ..... 10-2017-0167531

(51) Int. Cl.
*H01F 27/28* (2006.01)
*H01F 41/04* (2006.01)
(Continued)

(52) U.S. Cl.
CPC ..... *H01F 27/2804* (2013.01); *H01F 17/0006* (2013.01); *H01F 27/022* (2013.01);
(Continued)

(58) Field of Classification Search
CPC .... H01F 27/2804; H01F 27/29; H01F 27/022; H01F 27/255; H01F 27/327;
(Continued)

(56) References Cited

U.S. PATENT DOCUMENTS 4,641,113 A * 2/1987 Ozawa ..... H01P 9/00 333/161
4,803,453 A * 2/1989 Tomono ..... H01F 17/0013 336/183
(Continued)

FOREIGN PATENT DOCUMENTS

CN 1053760 C 6/2000
CN 1519867 A 8/2004
(Continued)

OTHER PUBLICATIONS

First Office Action dated Jun. 30, 2020 in Chinese Patent Application No. 201811091741.X (with English translation).

*Primary Examiner* — Mang Tin Bik Lian
(74) *Attorney, Agent, or Firm* — Morgan, Lewis & Bockius LLP

(57) ABSTRACT

A thin film coil component includes a body and first and second external electrodes. The body includes a first coil having wound with respect to a first axial direction and having a first seed layers and a first coil plating layer formed disposed on the first seed layers; a second coil connected to the first coil, wound with respect to a second axial direction parallel to the first axial direction, and having a second seed layers and a second plating layer disposed on the second seed layers; a connection portion connecting the first coil and the second coil to each other and and disposed in a direction perpendicular to the first and second axial directions; and a sealing member sealing the first and second coils and the connection portion.

18 Claims, 3 Drawing Sheets

(51) Int. Cl.
*H01F 27/29* (2006.01)
*H01F 27/02* (2006.01)
*H01F 17/00* (2006.01)

(52) U.S. Cl.
CPC ..... *H01F 27/29* (2013.01); *H01F 41/042* (2013.01); *H01F 2017/004* (2013.01)

(58) Field of Classification Search
CPC ..... H01F 41/042; H01F 17/0006; H01F 17/0033; H01F 2017/004; H01F 2017/0046; H01F 2017/048
USPC ..... 336/200, 223, 170, 192
See application file for complete search history.

(56) References Cited

U.S. PATENT DOCUMENTS 5,446,428 A * 8/1995 Kumeji ..... H01F 27/022 249/134
6,008,102 A * 12/1999 Alford ..... H01L 23/5227 257/531
6,031,445 A * 2/2000 Marty ..... H01F 27/2804 257/E21.022
7,088,215 B1 * 8/2006 Winter ..... H01F 17/0033 29/602.1
7,414,506 B2 * 8/2008 Furumiya ..... H01L 23/5227 257/E21.022
7,868,727 B2 * 1/2011 Chen ..... H01F 17/0013 336/192
7,948,342 B2 * 5/2011 Long ..... H01F 37/00 336/147
8,686,821 B2 * 4/2014 Chang ..... H01F 17/0013 336/147
10,312,015 B2 6/2019 Ogino et al.
2002/0105406 A1 * 8/2002 Liu ..... H01F 17/0006 336/200
2004/0183645 A1 9/2004 Takaya et al.
2009/0045904 A1 2/2009 Chen et al.
2010/0019871 A1 1/2010 Washiro
2010/0182118 A1 * 7/2010 Roskos ..... H01F 17/02 336/200
2013/0187743 A1 7/2013 Chang et al.
2014/0247269 A1 * 9/2014 Berdy ..... H01F 1/24 345/501
2016/0307686 A1 10/2016 Moon et al.
2017/0278624 A1 * 9/2017 Ogino ..... H01F 27/022

FOREIGN PATENT DOCUMENTS

CN 101640554 A 2/2010
CN 103219139 A 7/2013
CN 107230542 A 10/2017
EP 0593020 A1 4/1994
JP H11-204337 A 7/1999
JP 2005-294686 A 10/2005
KR 10-1999-0066108 A 8/1999
KR 10-2016-0123676 A 10/2016
TW 200908031 A 8/1996

* cited by examiner

'A'

I-I'

THIN FILM COIL COMPONENT

CROSS-REFERENCE TO RELATED APPLICATION(S)

This application is based on and claims the benefit of priority to Korean Patent Application No. 10-2017-0167531 filed on Dec. 7, 2017 in the Korean Intellectual Property Office, the entire disclosure of which is incorporated herein by reference.

TECHNICAL FIELD

The present disclosure relates to a thin film coil component and, more particularly, to a thin film power coil component.

BACKGROUND

A DC-DC converter of a mobile device, operating with a battery, is used to convert a supplied voltage into a voltage required in an internal circuit through a PMIC integrated in a single chip. Here, a capacitor and a coil component, passive components, are required. Recently, with an increase of power consumption due to various mobile device functions, passive components with less loss and excellent efficiency around the PMIC may be adopted in order to increase a battery use time in mobile devices. Among such passive components, a small and low-profile power coil component capable of reducing product size and increasing battery capacity due to having excellent efficiency is preferred.

SUMMARY

An aspect of the present disclosure may provide a thin film coil component capable of implementing a low-profile chip by reducing the total thickness of a coil while increasing an aspect ratio (AR) of the coil by changing a structure of the conventional thin film power coil component.

According to an aspect of the present disclosure, a thin film coil component may include a body including a first coil wound with respect to a first axial direction and having a first seed layer and a first plating layer formed on the first seed layer; a second coil connected to the first coil, having a second axial direction parallel to the first axial direction, and including a second seed layer and a second plating layer formed on the second seed layer; a connection portion connecting the first coil and the second coil to each other and disposed in a direction perpendicular to the first and second axial directions; and a sealing member sealing the first and second coils and the connection portion; and first and second external electrodes disposed on an external surface of the body and connected to the first and second coils, respectively.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments in the present disclosure will now be described in detail with reference to the accompanying drawings.

Figure 1:
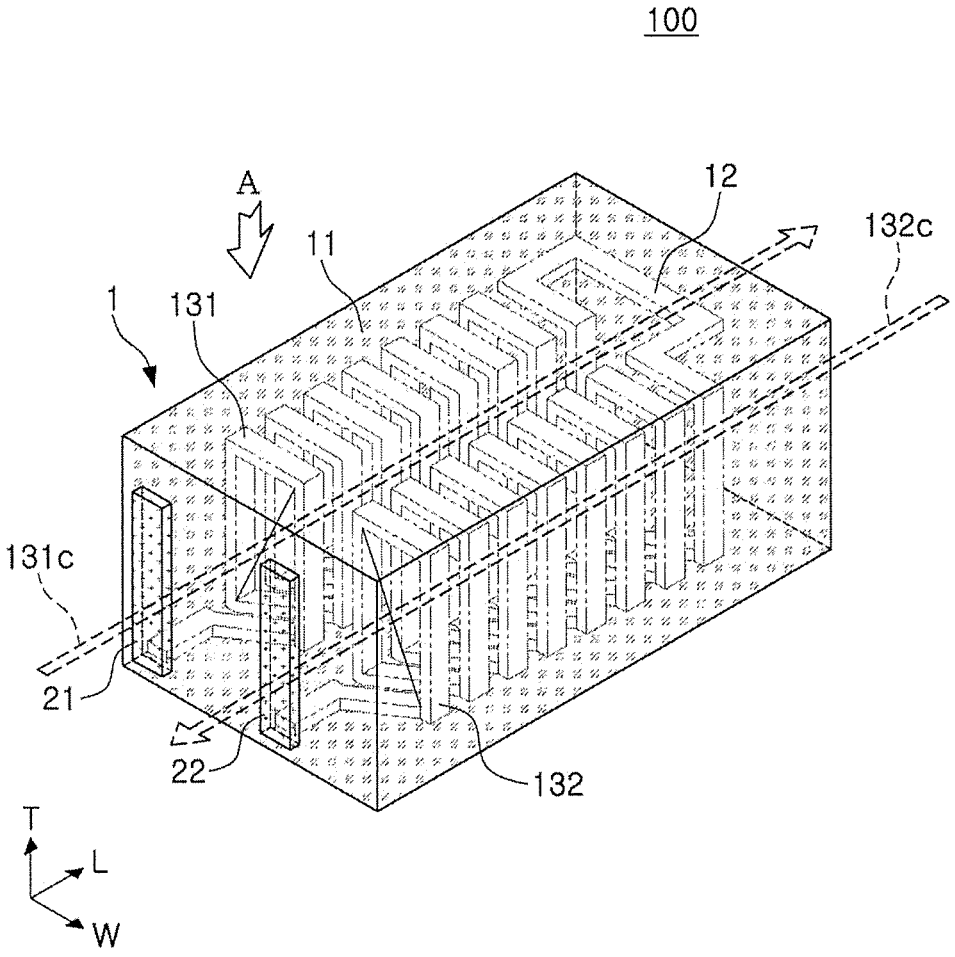
FIG. 1 is a schematic perspective view of a thin film coil component according to an exemplary embodiment in the present disclosure.
Figure 2:
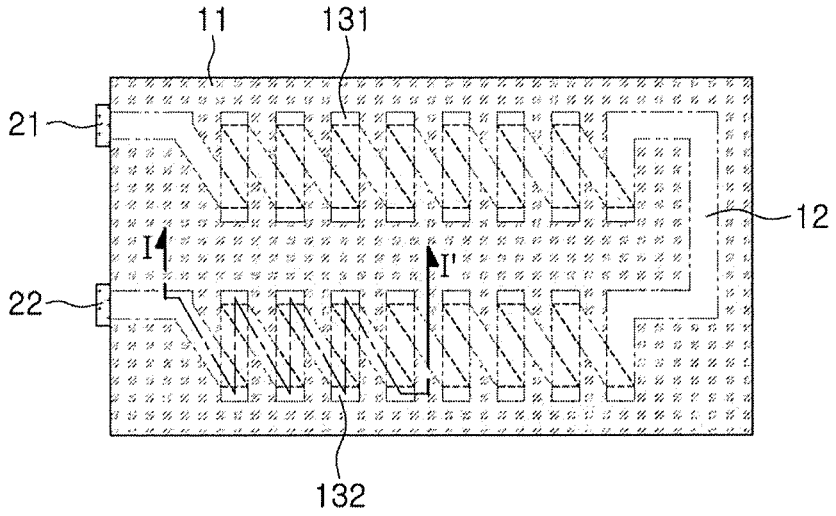
FIG. 2 is a schematic plan view of the thin film coil component viewed in a direction A of FIG. 1.

FIG. 1 is a schematic perspective view of a coil component according to an exemplary embodiment in the present disclosure. FIG. 2 is a schematic plan view of a thin film coil component of FIG. 1 viewed from an upper surface thereof.

Referring to FIGS. 1 and 2, a schematic thin film coil component 100 according to an exemplary embodiment in the present disclosure includes a body 1 and first and second external electrodes 21 and 22 disposed on an external surface of the body 1.

The body 1 exhibits an appearance of the thin film coil component 100 and may include an upper surface and a lower surface facing each other in a direction of a thickness T, a first end surface and a second end surface facing each other in a direction of a length L, and a first side surface and a second side surface facing each other in a direction of a width W to include a substantially hexahedral shape, but is not limited thereto.

The body 1 includes a magnetic material 11. The magnetic material 11 substantially determines an appearance of the body 1. The magnetic material 11 may include a material having a magnetic property and may be formed, for example, filled with ferrite or a metal-based soft magnetic material. The ferrite may include a known ferrite such as Mn—Zn ferrite, Ni—Zn ferrite, Ni—Zn—Cu ferrite, Mn—Mg ferrite, Ba ferrite or Li ferrite, etc. The metal-based soft magnetic material may be an alloy including at least one selected from the group consisting of Fe, Si, Cr, Al and Ni, and may include, for example, Fe—Si—B—Cr based amorphous metal particles but is not limited thereto. The metal-based soft magnetic material may have a particle diameter of 0.1 to 20 μm and may be dispersed on a polymer such as epoxy resin or polyimide.

The magnetic material 11 is arranged to simultaneously seal a first coil 131, a second coil 132, and a connection portion 12 connecting the first and second coils 131 and 132. In this regard, the magnetic material 11 may be referred to as a sealant.

The first and second coils 131 and 132 include a first magnetic core 131*c* and a second magnetic core 132*c*, respectively. The first magnetic core 131*c* and the second magnetic core 132*c* are merely different in a direction and may be arranged substantially in parallel to each other. Specifically, the first and second magnetic cores 131*c* and 132*c* extend along a length direction L of the body 1. In particular, the first magnetic core 131*c* extends toward (+) of the length L direction of the body 1, and the second magnetic core 132*c* extends toward (−) of the length L direction of the body 1. This is an explanation for a case where the first and second coils 131 and 132 are actually connected to an external power supply through the first and second external electrodes 21 and 22.

Also, each of the first and second coils 131 and 132 has a spiral shape, but is not limited thereto. However, the spiral shape realized by the first and second coils 131 and 132 is different from the spiral shape realized by the conventional thin film coil component. For example, the spiral shape may be a spiral shape having a rectangular column shape as a whole, other than a circular column shape.

The connection portion 12 for electrically connecting the first and second coils 131 and 132 to each other is disposed to be perpendicular to the first and second magnetic cores 131*c* and 132*c*. This is distinguished from a conventional thin film coil component in which connection portions (vias) connecting a plurality of coils are arranged in parallel to magnetic cores of the respective coils. Both ends of the connection portion 12 are respectively connected to the first and second coils 131 and 132 without a separate support member such that the connection portion 12 is embedded in the magnetic material 11.

Figure 3:
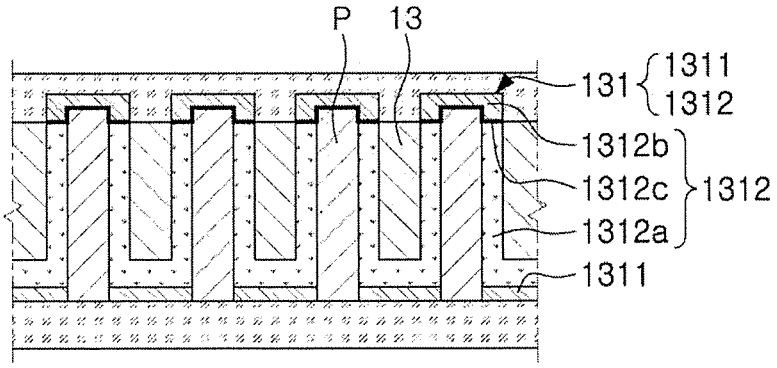
FIG. 3 is a schematic cross-sectional view taken along a line I-I' of FIG. 1.

Meanwhile, FIG. 3 is a schematic cross-sectional view taken along a line I-I' of FIG. 1. The first and second coils 131 and 132 will be described in detail with reference to FIG. 3. However, since a description of the first coil 131 may be directly applied to a description of the second coil 132, a separate description of the second coil 132 will be omitted for convenience of explanation. Specifically, descriptions of a first seed layer 1311 and a first plating layer 1312 of the first coil 131 may be directly applied to descriptions of a second seed layer 1321 and a second plating layer 1322 of the second coil 132.

Referring to FIG. 3, the first coil 131 includes the first seed layer 1311 and the first plating layer 1312 formed on the first seed layer 1311. The first seed layer 1311 and the first plating layer 1312 may be made of different materials. For example, the first seed layer 1311 may include a conductive material to which a sputtering process such as Ti and Ni is applicable and the first plating layer 1312 may include a conductive material to which a usual plating process such as Cu is applicable. The first seed layer 1311 and the first plating layer 1312 may include materials different from each other. Even if the first seed layer 1311 and the first plating layer 1312 include the same material, a predetermined interface may exist between the first seed layer 1311 and the first plating layer 1312.

The first seed layer 1311 constitutes a lower surface of the first coil 131 as a whole. The first coil 131 is formed by forming the first plating layer 1312 on the first seed layer 1311 as a base, thereby ensuring an overall aspect ratio (AR) of a coil substantially through the first plating layer 1312.

A method of forming the first seed layer 1311 is not limited and, for example, may be appropriately selected by those skilled in the art according to process requirements and product specifications such as sputtering, electrolytic plating, and electroless plating.

The first plating layer 1312 is configured to substantially ensure the overall AR of the coil and simultaneously to be connected to the first seed layer 1311 disposed therebelow. The first plating layer 1312 includes at least a first layer 1312*a* and a second layer 1312*b*. A cross section of the first layer 1312*a* has a substantially rectangular shape, but is not limited thereto. Although the cross section of the first layer 1312*a* is not limited to having the substantially rectangular shape, for example, after a plurality of insulating sheets are laminated on the first seed layer 1311, the insulating sheets are exposed and developed in order to have an opening for forming the first layer 1312*a*, and then plating may be performed into the opening. In this case, the insulating sheets function to prevent a plating layer from being deformed into a mushroom shape or a bell shape upon plating.

Next, the second layer 1312*b* of the first plating layer 1312 is disposed on an upper side of the first layer 1312*a*. Unlike the rectangular cross section of the first layer 1312*a*, a cross section of the second layer 1312*b* may have, for example, a "⌈ ⌉" shape. This is because an upper surface of the second layer 1312*b* substantially determines a shape of an upper surface of the first coil 131.

Meanwhile, according to a method of forming the second layer 1312*b*, a third layer 1312*c* may further be included between the first layer 1312*a* and the second layer 1312*b*. The third layer 1312*c* is configured as a thin conductive film having a substantially concave-convex structure. The method of forming the third layer 1312*c* is not limited, and it is sufficient that the third layer 1312*c* may be configured as a thin film having a substantially uniform thickness. For example, chemical plating may be utilized. Since the third layer 1312*c* is formed through a separate process from the first layer 1312*a* and the second layer 1312*b*, the third layer 1312*c* may be distinguished as a separate layer from the first layer 1312*a* and the second layer 1312*b*. Since it is sufficient that the third layer 1312*c* is a conductive material, there is a high degree of freedom in selecting a material of the third layer 1312*c*. The third layer 1312*c* substantially functions as a seed pattern for the second layer 1312*b* in view of a function, and the second layer 1312*b* is plated with the third layer 1312*c* as a seed layer.

Referring to FIG. 3, an insulating material 13 is disposed in entirely a space P between the first layers of the first plating layer 1312. The insulating material 13 may be a material functioning to improve reliability of insulation between adjacent first plating layers. For example, the insulating material 13 may be formed by laminating an insulating film such as ABF in the space P between the first layers. Meanwhile, although not specifically shown, at least apart of the space P may be filled with a magnetic material. In a case where the space P between the first layers is relatively large, and in a case where there is a margin in the space P between the first layers even when an insulating layer for coating a surface of the first layer is disposed, the magnetic material may be additionally filled in order to increase the magnetic permeability.

Also, apart of the second layer 1312*b* of the first coil 131 disposed farthest in the (+) direction of the length L direction of the body 1 is directly connected to the connection portion 12. The first coil 131 may be electrically connected to the second coil 132 through the connection portion 12. In this case, when the connection portion 12 is directly connected to the second coil 132, it is economical to directly connect the connection portion 12 to the second seed layer 1321 of the second coil 132.

The description of the first coil 131 may be applied to the second coil 132 connected to the first coil 131 through the connection portion 12.

For reference, a method of manufacturing the first coil 131 will be described. (a) As a step of preparing a support member, since the support member is a configuration removed from a final product, it is desirable to select a material easily removable with a laser or the like. A thickness of the support member may be appropriately selected and may be selected in consideration of a characteristic of the material and required mechanical strength. Meanwhile, the support member may use a conventional PCB substrate, but when the PCB substrate is not completely removed, a remaining portion may occur. Even when a part of the PCB substrate remains, the part may be remained in a case where the remaining part does not affect an electrical characteristic value. Next, (b) the first seed layer 1311 having a predetermined pattern is disposed on the support member. A method of disposing the first seed layer 1311 is not particularly limited. All electroless plating, electrolytic plating, sputtering, or the like may be applied. (c) An insulating pattern for forming the first plating layer 1312 on the first seed layer 1311. The insulating pattern may be formed by laminating a plurality of insulating sheets and then exposing and developing the insulating sheets to have a predetermined pattern. (d) Next, the first layer 1312*a* of the first plating layer 1312 is formed using the first seed layer 1311 previously provided in an opening of the insulating pattern as a base. In this case, a method of forming the first plating layer 1312 is not particularly limited. Usual electrolytic plating may be applied. (e) After the first plating layer 1312 is formed, the insulating pattern may be removed. ABF lamination may be performed in a space from which the insulating pattern is removed, or a magnetic material may be filled in the space. (f) A chemical layer of the third layer 1312*c* having a concave-convex structure may be formed on the first layer 1312*a* and an ABF lamination layer or a layer filled with the magnetic material. This is a process that may be selectively omitted according to the method of forming the second layer 1312*b* on the first layer 1312*a*. (g) A process of forming the second layer 1312*b* on the first layer 1312*a* and the third layer 1312*c* includes additionally disposing the insulating pattern, and then plating the second layer 1312*b* into the opening of the insulating pattern. Thereafter, the second coil 132 is formed on the opposite surface to one surface of the support member on which the first coil 131 is disposed, and thus the first and second coils 131 and 132 are arranged to face each other with respect to the support member. Subsequently, the support member may be removed through a process of removing the support member, and then the magnetic material or the insulating material may be filled into a space from which the support member is removed.

Except for the above description, the overlapping description of the features of the thin film coil component according to an example in the present disclosure described above will be omitted here.

Figure 4:
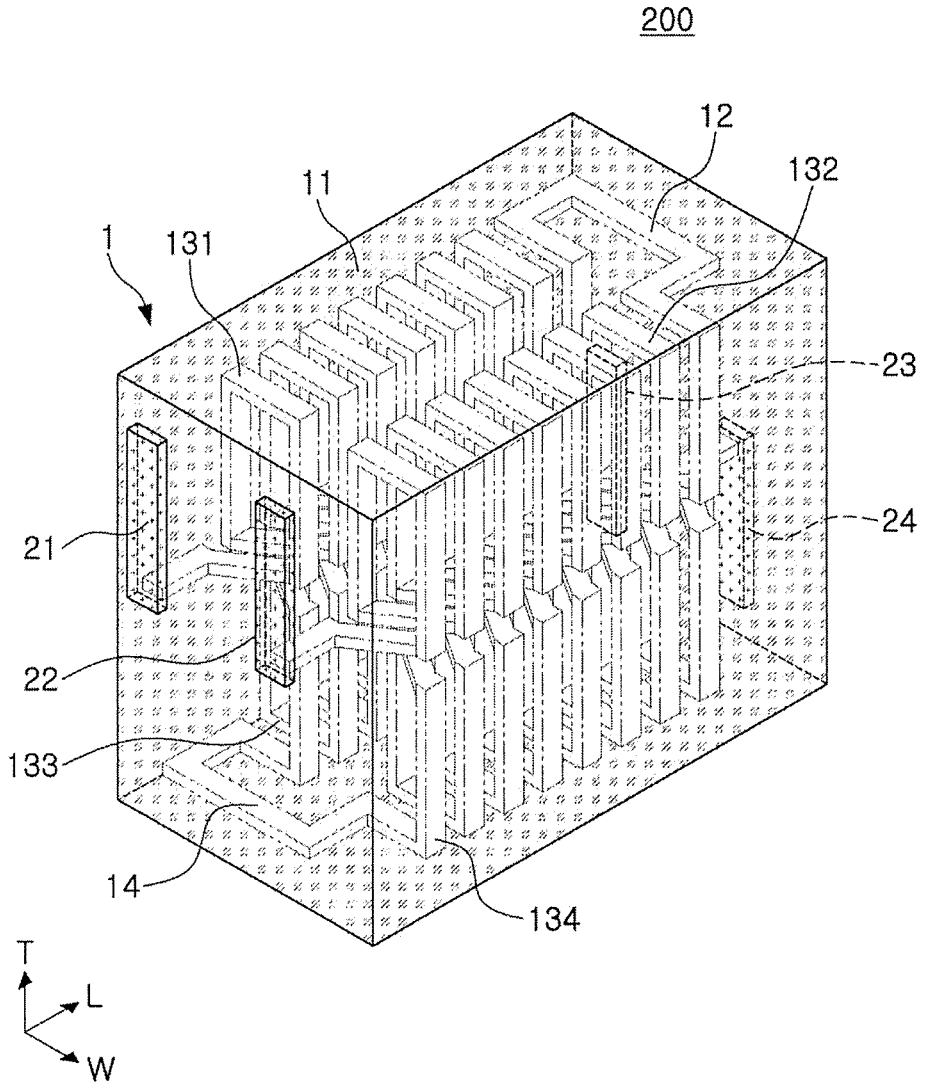
FIG. 4 is a schematic perspective view of a thin film coil component according to a modification of the thin film coil component of FIG. 1.

Next, FIG. 4 is a schematic perspective view of a thin film coil component 200 according to a modification of the thin film coil component 100 of FIG. 1.

As compared to the thin film coil component 100 described in FIGS. 1 through 3, the thin film coil component 200 of FIG. 4 further includes a third coil 133 on the same plane as the first coil 131 and further includes a fourth coil 134 on the same plane as the second coil 132. Further, the thin film coil component 200 further includes an additional connection portion 14 connecting the third and fourth coils 133 and 134 to each other, a third external electrode 23 electrically connected to the third coil 133, and a fourth external electrode 24 electrically connected to the fourth coil 134. Here, the third coil 133 is disposed on the same plane as the first coil 131 means that the third coil 133 is disposed at the same position as the first coil 131 with respect to a thickness T direction and a length L direction and is spaced apart from the first coil 131 by a predetermined space in a width W direction. The same content as above is applied to the fourth coil 134 and the second coil 132.

As shown in FIG. 4, the third coil 133 is connected to the fourth coil 134, and the first coil 131 is connected to the second coil 132, while the first and second coils 131 and 132 and the third and fourth coils 133 and 134 are physically separated from each other and a spacing therebetween may be suitably set by a person skilled in the art if necessary. The additional connection portion connecting the third and fourth coils 133 and 134 to each other is positioned to face the connection portion connecting the first and second coils 131 and 132 (with respect to the length L direction).

FIG. 4 discloses the thin film coil component 200 according to an embodiment further including the third and fourth coils 133 and 134 but is not limited thereto. Those skilled in the art may adopt a predetermined additional coil and external electrode if necessary.

As set forth above, since a conventional thin film coil component includes a substrate as a support member, it was difficult to implement a low-profile thin film coil component. The present disclosure provides a thin film coil component capable of reducing the total thickness of the thin film coil component while having a high AR by changing a structure thereof.

While exemplary embodiments have been shown and described above, it will be apparent to those skilled in the art that modifications and variations could be made without departing from the scope in the present disclosure as defined by the appended claims.

What is claimed is:

1. A thin film coil component comprising: a body including:

a first coil wound with respect to a first axial direction and having a first seed layer and a first plating layer disposed on the first seed layer;

a second coil connected to the first coil, wound with respect to a second axial direction parallel to the first axial direction, and having a second seed layer and a second plating layer disposed on the second seed layer; and a connection portion connecting the first coil and the second coil to each other, wherein a portion of the connection portion extends in a direction perpendicular to the first and second axial directions; and first and second external electrodes disposed on an external surface of the body and connected to the first and second coils, respectively, wherein both ends of the connection portion are respectively connected to a farthest end of the first coil from the first external electrode in the first axial direction and a farthest end of the second coil from the second external electrode in the second axial direction, and said portion of the connection portion includes only two ends which are connected to the respective first and second coils, wherein the first seed layer includes a plurality of seed layers separated from each other, and are electrically connected by connecting two adjacent seed layers of the plurality of seed layers through the first plating layer, and the first plating layer includes at least a first layer and a second layer disposed on the first layer, and wherein a cross section of the first layer is rectangular, and the first layer is physically spaced apart from another adjacent first layer and is connected to another adjacent first layer through the second layer.

2. The thin film coil component of claim 1, wherein each of the first and second coils has a spiral shape.

3. The thin film coil component of claim 1, wherein each of the first and second coils has a spiral shape having a rectangular column shape as a whole.

4. The thin film coil component of claim 1, wherein the first plating layer further includes a third layer interposed between the first layer and the second layer, and the third layer is thinner than the first layer or the second layer.

5. The thin film coil component of claim 1, wherein a lower surface of the second layer of the first plating layer has a concave-convex structure.

6. The thin film coil component of claim 1, wherein at least a part of a space formed between each coil turn of the first plating layer is filled with a magnetic material.

7. The thin film coil component of claim 1, wherein a space formed between each coil turn of the first plating layer is entirely filled with an insulating material.

8. The thin film coil component of claim 1, wherein the second coil has a substantially identical structure to the first coil.

9. The thin film coil component of claim 1, wherein the connection portion is connected to the first plating layer of the first coil and the second plating layer of the second coil.

10. The thin film coil component of claim 1, wherein a magnetic material is disposed in a space formed between the first and second coils.

11. The thin film coil component of claim 1, wherein both of the first and second external electrodes are arranged to face the same side of the connection portion.

12. The thin film coil component of claim 11, wherein the first and second external electrodes are spaced apart from each other by a predetermined distance on one surface of the body.

13. The thin film coil component of claim 1, wherein the body further includes:

a third coil disposed below the first coil; and a fourth coil disposed below the second coil.

14. The thin film coil component of claim 13, wherein the third and fourth coils are connected by an additional connection portion.

15. The thin film coil component of claim 13, further comprising:

third and fourth external electrodes disposed on another external surface of the body and connected to the third and fourth coils, respectively, wherein both of the third and fourth external electrodes are arranged to face the same side of the additional connection portion.

16. The thin film coil component of claim 1, wherein the first and second external electrodes are disposed on only one surface of the body.

17. A thin film coil component comprising:

a body including:

a first coil wound with respect to a first axial direction and having a first seed layer and a first plating layer disposed on the first seed layer;

a second coil connected to the first coil, wound with respect to a second axial direction parallel to the first axial direction, and having a second seed layer and a second plating layer disposed on the second seed layer; and a connection portion connecting the first coil and the second coil to each other and extending in a direction perpendicular to the first and second axial directions; and first and second external electrodes disposed on an external surface of the body and connected to the first and second coils, respectively, wherein each of the first and second plating layers includes a first layer and a second layer disposed on the respective first layer, and further includes a third layer interposed between the respective first and second layers, and each third layer has a concave-convex structure.

18. A thin film coil component comprising: a body including:

a first coil wound with respect to a first axial direction and having a first seed layer and a first plating layer disposed on the first seed layer;

a second coil connected to the first coil, wound with respect to a second axial direction parallel to the first axial direction, and having a second seed layer and a second plating layer disposed on the second seed layer; and a connection portion connecting the first coil and the second coil to each other wherein a portion of the connection portion extends in a direction perpendicular to the first and second axial directions; and first and second external electrodes disposed on an external surface of the body and connected to the first and second coils, respectively, wherein the body includes a magnetic material sealing the first and second coils and the connection portion, the first coil is arranged and configured such that a first magnetic core extends in a space formed between each coil turn of the first plating layer in the first axial direction, the second coil is arranged and configured such that a second magnetic core extends in a space formed between each coil turn of the second plating layer in the second axial direction, the first and second magnetic cores extend in parallel and in opposite directions, and said portion of the connection portion includes only two ends which are connected to the respective first and second coils, wherein the first seed layer includes a plurality of seed layers separated from each other, and are electrically connected by connecting two adjacent seed layers of the plurality of seed layers through the first plating layer, and the first plating layer includes at least a first layer and a second layer disposed on the first layer, and wherein a cross section of the first layer is rectangular, and the first layer is physically spaced apart from another adjacent first layer and is connected to another adjacent first layer through the second layer.

* * * * *